US006850715B2

(12) United States Patent
Maehara

(10) Patent No.: US 6,850,715 B2
(45) Date of Patent: Feb. 1, 2005

(54) IMAGE FORMING APPARATUS WITH DEVELOPER DETECTOR

(75) Inventor: Shigeharu Maehara, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 268 days.

(21) Appl. No.: 09/799,074

(22) Filed: Mar. 6, 2001

(65) Prior Publication Data

US 2001/0021313 A1 Sep. 13, 2001

(30) Foreign Application Priority Data

Mar. 7, 2000 (JP) ..... P2000-061934

(51) Int. Cl.[7] ..... G03G 15/08
(52) U.S. Cl. ..... 399/27
(58) Field of Search ..... 399/27, 24, 25, 399/9

(56) References Cited

U.S. PATENT DOCUMENTS 5,272,503 A * 12/1993 LeSueur et al. ..... 399/25
5,283,613 A * 2/1994 Midgley, Sr. ..... 399/9
5,946,522 A * 8/1999 Inami ..... 399/27
6,266,492 B1 7/2001 Maehara
6,332,062 B1 * 12/2001 Phillips et al. ..... 399/12
6,347,198 B1 * 2/2002 Yamamoto et al. ..... 399/27
6,385,407 B1 * 5/2002 Inose ..... 399/24

FOREIGN PATENT DOCUMENTS

JP B2462075 10/1992
JP 10-161411 * 6/1998
JP 10-186770 * 7/1998

* cited by examiner

*Primary Examiner*—Quana Grainger
(74) *Attorney, Agent, or Firm*—Birch, Stewart, Kolasch, & Birch, LLP.

(57) ABSTRACT

An image forming apparatus in which printing with a developer whose lifetime has been exceeded can be prevented to avoid unstable printing, and an image forming apparatus in which erroneous insertion of a developer supply container can be prevented from occurring are is provided. An image forming apparatus has an apparatus body having an image forming unit, and a developer supply container which is detachably attached to the image forming unit to supply a developer in accordance with image formation. An IC chip having a nonvolatile memory for storing information relating to the developer supply container is disposed in the developer supply container. Processing means having a function of writing predetermined information into the nonvolatile memory is disposed in the apparatus body.

22 Claims, 7 Drawing Sheets

FIG. 5

DEVELOPER LIFETIME INFORMATION STORAGE AREA

REWRITABLE PORTION

| ADDRESS | 1 | 2 | ···· | i-1 | i | i+1 | ···· | m-1 | m |
|---|---|---|---|---|---|---|---|---|---|
| CONTENTS | 00 | 00 | ···· | 00 | 00 | 00 | ···· | 00 | 00 |

NON-REWRITABLE PORTION

| ADDRESS | 1 | 2 | ···· | j-1 | j | j+1 | ···· | n-1 | n |
|---|---|---|---|---|---|---|---|---|---|
| CONTENTS | 00 | 00 | ···· | 00 | 00 | 00 | ···· | 00 | 00 |

FIG. 6

DEVELOPER LIFETIME INFORMATION STORAGE AREA

REWRITABLE PORTION

| ADDRESS | 1 | 2 | ···· | i-1 | i | i+1 | ···· | m-1 | m |
|---|---|---|---|---|---|---|---|---|---|
| CONTENTS | FF | FF | ···· | FF | FF | 00 | ···· | 00 | 00 |

NON-REWRITABLE PORTION

| ADDRESS | 1 | 2 | ···· | j-1 | j | j+1 | ···· | n-1 | n |
|---|---|---|---|---|---|---|---|---|---|
| CONTENTS | 00 | 00 | ···· | 00 | 00 | 00 | ···· | 00 | 00 |

FIG. 7

DEVELOPER LIFETIME INFORMATION STORAGE AREA

REWRITABLE PORTION

| ADDRESS | 1 | 2 | ···· | i-1 | i | i+1 | ···· | m-1 | m |
|---|---|---|---|---|---|---|---|---|---|
| CONTENTS | FF | FF | ···· | FF | FF | FF | ···· | FF | FF |

NON-REWRITABLE PORTION

| ADDRESS | 1 | 2 | ···· | j-1 | j | j+1 | ···· | n-1 | n |
|---|---|---|---|---|---|---|---|---|---|
| CONTENTS | 00 | 00 | ···· | 00 | 00 | 00 | ···· | 00 | 00 |

FIG. 8

DEVELOPER LIFETIME INFORMATION STORAGE AREA

REWRITABLE PORTION

| ADDRESS | 1 | 2 | ···· | i-1 | i | i+1 | ···· | m-1 | m |
|---|---|---|---|---|---|---|---|---|---|
| CONTENTS | 00 | 00 | ···· | 00 | 00 | 00 | ···· | 00 | 00 |

NON-REWRITABLE PORTION

| ADDRESS | 1 | 2 | ···· | j-1 | j | j+1 | ···· | n-1 | n |
|---|---|---|---|---|---|---|---|---|---|
| CONTENTS | FF | 00 | ···· | 00 | 00 | 00 | ···· | 00 | 00 |

FIG. 9

DEVELOPER LIFETIME INFORMATION STORAGE AREA

REWRITABLE PORTION

| ADDRESS | 1 | 2 | ···· | i-1 | i | i+1 | ···· | m-1 | m |
|---|---|---|---|---|---|---|---|---|---|
| CONTENTS | FF | FF | ···· | FF | FF | FF | ···· | FF | FF |

NON-REWRITABLE PORTION

| ADDRESS | 1 | 2 | ···· | j-1 | j | j+1 | ···· | n-1 | n |
|---|---|---|---|---|---|---|---|---|---|
| CONTENTS | FF | FF | ···· | FF | FF | FF | ···· | FF | 00 |

FIG. 10

DEVELOPER LIFETIME INFORMATION STORAGE AREA

REWRITABLE PORTION

| ADDRESS | 1 | 2 | ···· | i-1 | i | i+1 | ···· | m-1 | m |
|---|---|---|---|---|---|---|---|---|---|
| CONTENTS | 00 | 00 | ···· | 00 | 00 | 00 | ···· | 00 | 00 |

NON-REWRITABLE PORTION

| ADDRESS | 1 | 2 | ···· | j-1 | j | j+1 | ···· | n-1 | n |
|---|---|---|---|---|---|---|---|---|---|
| CONTENTS | FF | FF | ···· | FF | FF | FF | ···· | FF | FF |

FIG. 11

DEVELOPER LIFETIME INFORMATION STORAGE AREA

REWRITABLE PORTION

| ADDRESS | 1 | 2 | ···· | i-1 | i | i+1 | ···· | m-1 | m |
|---|---|---|---|---|---|---|---|---|---|
| CONTENTS | FF | FF | ···· | FF | FF | FF | ···· | FF | FF |

NON-REWRITABLE PORTION

| ADDRESS | 1 | 2 | ···· | j-1 | j | j+1 | ···· | n-1 | n |
|---|---|---|---|---|---|---|---|---|---|
| CONTENTS | FF | FF | ···· | FF | FF | FF | ···· | FF | FF |

IMAGE FORMING APPARATUS WITH DEVELOPER DETECTOR

BACKGROUND OF THE INVENTION

1. Field of the Invention

The present invention relates to a dry electrophotographic image forming apparatus in which replacement of a developer supply container is enabled, such as in a copying apparatus, a printing apparatus, or a facsimile apparatus.

2. Description of the Related Art

In an image forming apparatus of this type, replenishment of a developer in an image forming unit is performed by using a developer supply container when the developer ratio (T/D) in a developer tank is lowered. The work of replacing the developer supply container is often conducted by the user.

In an image forming apparatus of the conventional art, printing is sometimes performed with exceeding the lifetime of a developer, with the result that the printing quality becomes unstable.

In the case such as that where plural image forming apparatuses are disposed in one place, it is often that developers of the apparatuses are different in kind from each other. Even when photosensitive members of the same kind are used, for example, a developer for the analog method (positive development method) is opposite in polarity to that for the digital method (reversal development method). Even in developers of the same polarity, their components (CCA (charge control agent), resins, and the like) are varied in accordance with the charging characteristics (saturated charging quantity), whereby the resistances of the developers are made different from one another. In the case of color image formation, furthermore, the hue is different among black toner, red toner, etc.

When a developer which is non-interchangeable among the apparatuses is erroneously supplied to another apparatus by the user, this supplied developer causes the carrier to be consumed, and the developer to be blown out, with the result that troubles such as that the developer is scattered in the apparatus, and that the photosensitive member is deteriorated occur.

In order to solve these problems, a method is often used in which the shape of a container for a developer is changed in accordance with the kind of the apparatus in which the developer can be used, thereby preventing the container from being erroneously inserted.

When this method is employed, however, plural kinds of containers of different shapes must be prepared, and the production cost is therefore increased.

Japanese Examined Patent Publication JP-B2 4-62075 (1992) discloses a technique in which, when a developer supply container is attached to an apparatus, information (the replenishment quantity, the lot number, and the like) of a developer which is stored in a memory of the container is stored into a memory of the apparatus, and process conditions of image formation are changed in accordance with the information and the consumed quantity of the developer.

In the disclosed technique, the information stored in the developer supply container is used only for changing process conditions of image formation, and it is not judged whether the developer in the container attached to the apparatus is usable or not. Therefore, the technique cannot solve the above-discussed problem of erroneous insertion.

SUMMARY OF THE INVENTION

It is an object of the invention to provide an image forming apparatus in which printing with a developer whose lifetime has been exceeded can be prevented to avoid unstable printing quality.

It is another object of the invention to provide an image forming apparatus in which erroneous insertion of a developer supply container can be prevented.

The invention provides an image forming apparatus comprising:

an apparatus body having an image forming unit;

a developer supply container detachably attached to the image forming unit, for supplying a developer in forming an image;

container side nonvolatile storage means, disposed in the developer supply container, for storing information relating to the developer supply container; and processing means disposed in the apparatus body, having a function of writing predetermined information into the container side nonvolatile storage means.

For example, information stored in the container side nonvolatile storage means is not lost even when the power supply is stopped, and hence is not vanished even in the case where the power source of the image forming apparatus is turned off, or where the developer supply container is detached from the apparatus body.

For example, information relating to a lifetime of the developer is stored in the container side nonvolatile storage means, and the processing means of the apparatus body writes information relating to the lifetime of the developer into the container side nonvolatile storage means, detects replacement timing of the developer supply container from the information relating to the lifetime of the developer which is written into the nonvolatile storage means, and instructs replacement. According to this configuration, printing with a developer whose lifetime has been exceeded can be prevented to avoid unstable printing.

For example, the processing means of the apparatus body judges whether the developer supply container is usable or not, based on the information relating to the developer supply container which is stored in the container side nonvolatile storage means, and, if the developer supply container is not usable, inhibits a use of the developer supply container. According to this configuration, erroneous insertion of a developer supply container can be prevented from occurring, and the above-described troubles due to erroneous insertion can be prevented from being caused.

In the invention the image forming apparatus further comprises, for example, body side nonvolatile storage means for storing information relating to the developer supply container, and the processing means has a function of judging whether the developer supply container is usable or not, based on the information stored in the container side nonvolatile storage means, and the information stored in the body side nonvolatile storage means.

According to this configuration, when a developer supply container accommodating a developer which is not usable in the image forming apparatus is attached to the apparatus, it is possible to detect such attachment and inhibit the use of the container. Namely, erroneous insertion of a developer supply container can be prevented, and accordingly the above-described troubles due to erroneous insertion can be prevented.

In the image forming apparatus of the invention, the container side nonvolatile storage means is provided with a rewritable portion and a non-rewritable portion, and information of higher importance is written into the non-rewritable portion, information of lower importance being written into the rewritable portion.

In this case, for example, in the non-rewritable portion is stored information regarding kinds of image forming apparatuses to which the developer supply container is applicable, the kind of the developer accommodated in the container, etc.

According to this configuration, important information can be prevented from being rewritten, so that a trouble such as a malfunction due to rewriting can be prevented.

In the invention, the container side nonvolatile storage means is provided with a developer lifetime information storage area having a predetermined number of non-rewritable portions, in which area information relating to a lifetime of the developer is stored, and the processing means performs writing sequentially onto the non-rewritable portions each time a predetermined operation relating to the lifetime of the developer is performed a predetermined number of times in the image forming unit, and a time when writing onto the non-rewritable portions is disabled is recognized as replacement timing of the developer supply container.

Since information relating to the lifetime of the developer is written into the non-rewritable portions of the container side nonvolatile storage means, the information is never rewritten. When the processing means detects replacement timing of the developer supply container, instructions for replacement can be given. According to this configuration, printing with a developer whose lifetime has been exceeded can be prevented to avoid unstable printing quality.

In the above-mentioned image forming apparatus, the developer lifetime information storage area further has a predetermined number of rewritable portions, and the processing means repeats operations of:

writing sequentially onto the rewritable portions each time a predetermined operation relating to the lifetime of the developer is carried out a predetermined number of times in the image forming unit; and clearing the whole of the rewritable portions each time writing onto a whole of the rewritable portions is ended and writing sequentially onto the non-rewritable portions, and a time when writing onto the non-rewritable portions is disabled is recognized as replacement timing of the developer supply container.

In this case also, information relating to the lifetime of the developer and written into the non-rewritable portions of the container side nonvolatile storage means is never rewritten. Before recognition of the replacement timing of the developer supply container, the processing means can execute writing onto the developer lifetime information storage area such a number of times that is equal to a product of the number of rewritable portions and that of the non-rewritable portions. As compared with the case where the whole of the developer lifetime information storage area is used as the non-rewritable portions and writing is carried out sequentially onto the non-rewritable portions only, therefore, the total capacity of the developer lifetime information storage area which is required for carrying out the same number of writing operations can be reduced.

In the above-mentioned image forming apparatus, for example, the processing means instructs replacement of the developer supply container at a time when no further portion where writing is enabled exists as a result of writing onto the non-rewritable portions of the developer lifetime information storage area.

According to this configuration, printing with a developer whose lifetime has been exceeded can be prevented to avoid unstable printing quality.

In the above-mentioned image forming apparatus, for example, the processing means instructs replacement of the developer supply container at a time when, after no further portion where writing is enabled exists as a result of carrying out writing onto the non-rewritable portions of the developer lifetime information storage area, requirement for writing into the non-rewritable portions is then produced.

According to this configuration, printing with a developer whose lifetime has been exceeded can be prevented to avoid unstable printing quality.

BRIEF DESCRIPTION OF THE DRAWINGS

Other and further objects, features, and advantages of the invention will be more explicit from the following detailed description taken with reference to the drawings wherein:

FIG. 5 is a diagram showing an example of a written state of a lifetime information storage area in a memory of the IC chip in the developing unit;

FIG. 6 is a diagram showing another example of the written state of the lifetime information storage area in the memory of the IC chip in the developing unit;

FIG. 7 is a diagram showing a further example of the written state of the lifetime information storage area in the memory of the IC chip in the developing unit;

FIG. 8 is a diagram showing a still further example of the written state of the lifetime information storage area in the memory of the IC chip in the developing unit;

FIG. 9 is a diagram showing a still further example of the written state of the lifetime information storage area in the memory of the IC chip in the developing unit;

FIG. 10 is a diagram showing a still further example of the written state of the lifetime information storage area in the memory of the IC chip in the developing unit; and FIG. 11 is a diagram showing a still further example of the written state of the lifetime information storage area in the memory of the IC chip in the developing unit.

DETAILED DESCRIPTION OF THE PREFERRED EMBODIMENTS

Figure 1:
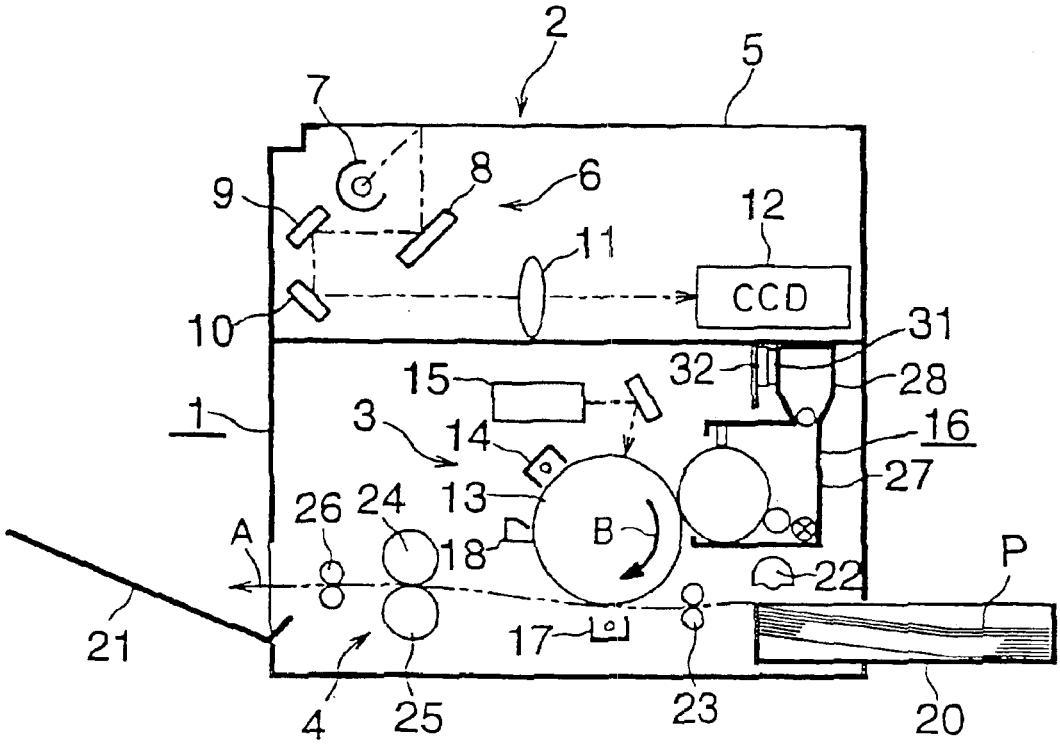
FIG. 1 is a schematic diagram of a dry electrophotographic copying apparatus which is an embodiment of the invention.

Now, referring to the drawings, an embodiment in which the invention is applied to a copying apparatus will be described.

FIG. 1 schematically shows the whole configuration of an image forming apparatus. In the following description, it is assumed that the right and left sides of FIG. 1 respectively correspond to those of the apparatus, the front side of the sheet of FIG. 1 corresponds to the front side of the apparatus, and the rear side of the sheet of FIG. 1 corresponds to the rear side of the apparatus, and also that the rear side (sheet supplying side) of the movement direction A of a recording sheet corresponds to the upstream side, and the front side (sheet discharging side) of the direction corresponds to the downstream side.

The image forming apparatus is configured by: an original reading unit 2 which is disposed in an upper portion of the apparatus body 1; an image forming unit 3 which is disposed in a lower portion of the apparatus body 1; a sheet transporting unit 4 which is disposed in the lower portion of the apparatus body 1; and a control unit (not shown) which controls the whole of the apparatus.

The original reading unit 2 has an original table 5 configured by transparent glass or the like, in the upper face. A scanner optical system 6 is disposed below the original table 5. The optical system 6 comprises an exposure light source 7, plural reflecting mirrors 8, 9, and 10, an imaging lens 11, and a CCD (charge coupled device) image sensor 12. An original placed on the original table 5 is optically-scanned by irradiation light from the light source 7, and reflection light from the original is guided to the CCD image sensor 12 via the reflecting mirrors 8, 9, and 10, and the lens 11. The original image data which are read by the CCD image sensor 12 are subjected to image processing and then sent to the image forming unit 3.

The image forming unit 3 comprises a drum-like photosensitive member 13 which is rotated in the rotation direction (clockwise direction in FIG. 1) indicated by the arrow B. Around the photosensitive member 13, a main charger 14 which charges the photosensitive member 13 to a given potential, a laser irradiating unit 15 which irradiates the surface of the charged photosensitive member 13 with a laser beam to form an electrostatic latent image, a developing unit 16 which develops by toner the electrostatic latent image on the surface of the photosensitive member 13 irradiated with a laser beam, to a visible image, a transfer charger 17 which transfers the toner image on the photosensitive member 13 to a recording sheet P, and a cleaning unit 18 which removes away residual toner on the surface of the photosensitive member 13 are sequentially arranged on the downstream side of the rotation direction B. The laser irradiating unit 15 irradiates the surface of the photosensitive member 13 with a laser beam, on the basis of the original image data which are read by the CCD image sensor 12 and subjected to the image processing as described above, thereby forming an electrostatic latent image.

The sheet transporting unit 4 is configured in the following manner.

A sheet cassette 20 which accommodates recording sheets P is attached to the right side of the lower portion of the apparatus body 1, and a sheet discharge tray 21 is disposed in the left side of the lower portion of the apparatus body 1. A semicircular roller 22 for supplying the sheet P is placed in a forward end portion of the sheet cassette 20. A preregistration detection switch (not shown) for detecting passing of the sheet P, and a registration roller 23 which performs positioning between the toner image on the photosensitive member 13 of the image forming unit 3 and the sheet P on the basis of a signal from the switch are placed in the downstream side (left side) of the cassette 20. A pair of fixing rollers 24 and 25 for thermally fixing the toner image on the sheet P, and a fixed-sheet detection switch (not shown) for detecting that the sheet P has passed through the fixing rollers 24 and 25 are placed in the downstream side of the image forming unit 3. A sheet discharging roller 26 which discharges the sheet P onto the sheet discharge tray 21 is placed in the downstream side of the fixing rollers 24 and 25. Although not illustrated, guides for guiding the sheet P are disposed in required places of the sheet transporting unit 4.

In the image forming apparatus, the sheet P is supplied from the cassette 20, and then transported to the image forming unit 3 via the registration roller 23. A toner image is transferred to the sheet P in the image forming unit 3, and the toner image is then fixed by the fixing rollers 24 and 25. Thereafter, the sheet P is discharged onto the sheet discharge tray 21 via the sheet discharging roller 26.

The developing unit 16 is replaceable, and detachably attached to the apparatus body 1. As shown in detail in FIG. 2, the developing unit 16 consists of a developer tank 27, and a toner box 28 which is disposed integrally with or detachably on the upper portion of the chamber, and is configured so that, in a state where the developing unit 16 is detached from the apparatus body 1, the toner box 28 can be replenished with the developer. In the embodiment, the whole of the developing unit 16 serves as the developer supply container. An IC (integrated circuit) chip 31 having a nonvolatile memory 30 (see FIG. 3) serving as the container side nonvolatile storage means for storing information relating to the developing unit 16 is fixed to a portion of the toner box 28 of the developing unit 16. When the developing unit 16 is attached to the apparatus body 1, the IC chip 31 is connected to a connector 32 disposed on the apparatus body 1.

Figure 2:
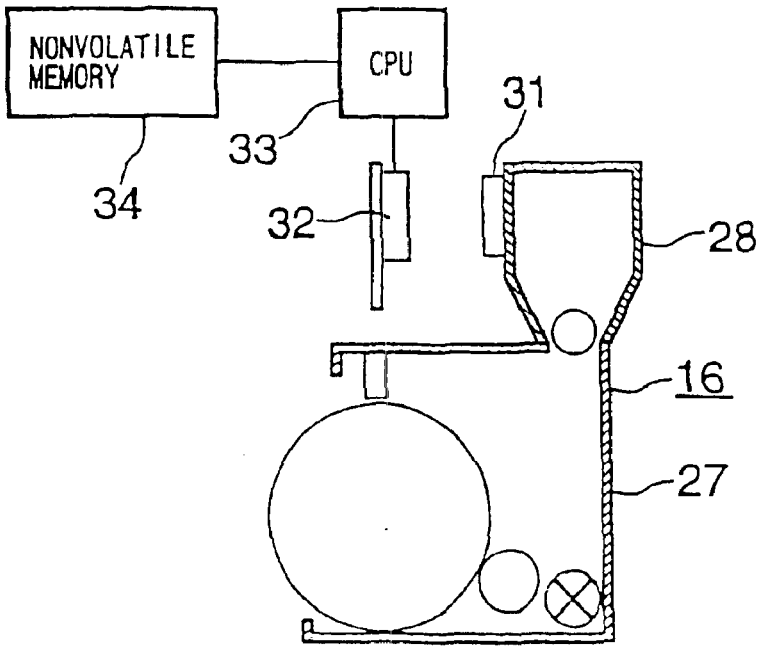
FIG. 2 is an enlarged schematic diagram showing a portion of a developing unit.

As shown in FIG. 2, a CPU (central processing unit) 33 constituting the processing means is disposed in the control unit of the apparatus body 1. The CPU 33 is connected to the connector 32 and a nonvolatile memory 34 serving as the body side nonvolatile storage means for storing information relating to the developing unit 16.

Figure 3A:
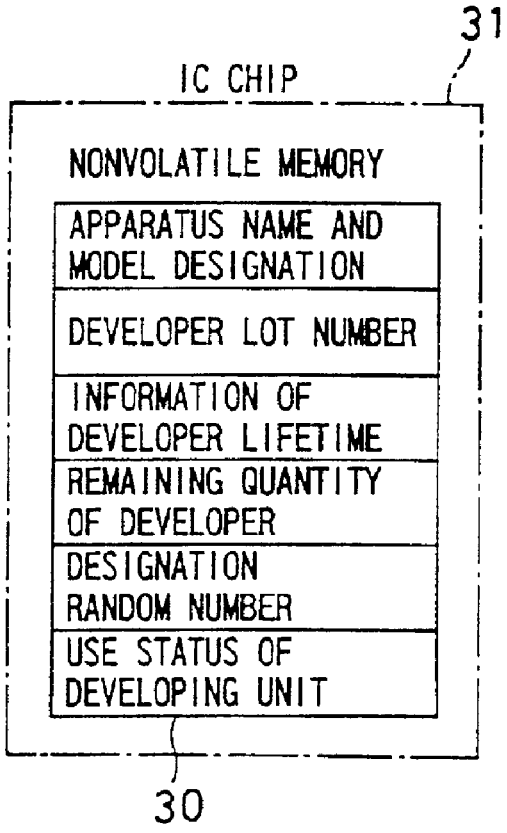
FIGS. 3A and 3B are diagrams respectively showing examples of contents of a nonvolatile memory of an IC chip in the developing unit, and of contents of a nonvolatile memory in the apparatus body.

As shown in FIG. 3A, the memory 30 of the IC chip 31 has areas such as: an area into which information relating to an image forming apparatus in which the developing unit 16 can be used, for example, the name and model designation of the apparatus is to be stored; an area into which information relating to the developer accommodated in the developing unit 16, for example, the lot number of the developer is to be stored; an area (developer lifetime information storage area) into which information relating to the lifetime of the developer that will be described later is to be stored; an area into which the remaining quantity of the developer in the developing unit 16 is to be stored; an area into which a designation random number that is generated by the CPU 33 of the apparatus body 1 as described later is to be stored; and an area into which information of the use status of the developing unit 16, i.e., whether the developing unit 16 has not be used or not is to be stored.

The memory 30 of the IC chip 31 includes a rewritable portion and a non-rewritable portion. The rewritable portion is a portion in which erasing and writing can be performed many times even after writing is once performed, and the non-rewritable portion is a portion in which erasing and writing are disabled after writing is once performed. Information of higher importance is written into the non-rewritable portion, and information of lower importance is written into the rewritable portion. For example, information relating to image forming apparatuses to which the developing unit 16 is applicable, and that relating to the developer accommodated in the container are stored in the non-rewritable portion. As described later in detail, the developer lifetime information storage area includes a rewritable portion and a non-rewritable portion.

Figure 3B:
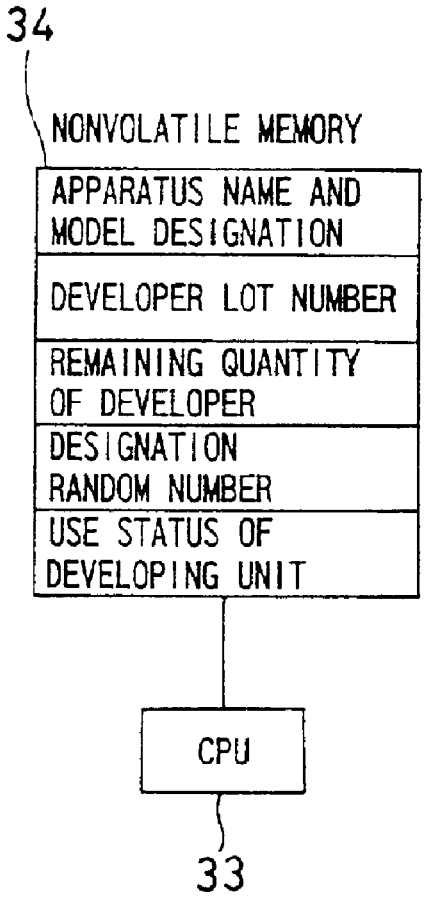

As shown in FIG. 3B, the memory 34 of the apparatus body 1 has areas such as: an area into which information relating to the image forming apparatus, for example, the name and model designation of the apparatus is to be stored; an area into which the information relating to the developer and read from the memory 30 of the IC chip 31, such as the lot number of the developer is to be stored; an area into which the remaining quantity of the developer that is calculated on the basis of the remaining quantity of the developer and read from the memory 30 of the IC chip 31 is to be stored; an area into which the designation random number that is generated by the CPU 33 in order to be written into the memory 30 of the IC chip 31 is to be stored; and an area into which the use status of the developing unit 16 and read from the memory 30 of the IC chip 31 is to be stored.

In the image forming apparatus, the CPU 33 judges whether or not the information of the image forming apparatus which is stored in the memory 34 of the apparatus body 1 is included in the information relating to image forming apparatuses to which the developing unit 16 is applicable, and read from the memory 30 of the IC chip 31. In accordance with a result of the judgment, a display panel (not shown) of the apparatus body 1 displays whether the developing unit 16 is applicable to the image forming apparatus or not. With setting the remaining developer quantity read from the memory 30 of the IC chip 31 as an initial value, the remaining developer quantity is calculated by subtracting from the initial value the consumed quantity of the developer which is obtained from, for example, the rotation number of a developer supplying roller of the developing unit 16. The calculated remaining quantity is written into the memory 34 of the apparatus body 1 and the memory 30 of the IC chip 31. When the remaining developer quantity reaches zero or a value in the vicinity of zero, it is judged that the developing unit 16 is empty. This judgment is displayed on the display panel to request replacement of the developing unit 16. When the developing unit 16 in an unused state is attached at the first time to the apparatus body 1, the designation random number is generated, and then written into the memory 34 of the apparatus body 1 and the memory 30 of the IC chip 31. Thereafter, the written random number is used for specifying the developing unit 16 attached to the apparatus body 1. These operations of the CPU 33 including the judgment are performed each time the power source of the apparatus body 1 is turned on.

Figure 4:
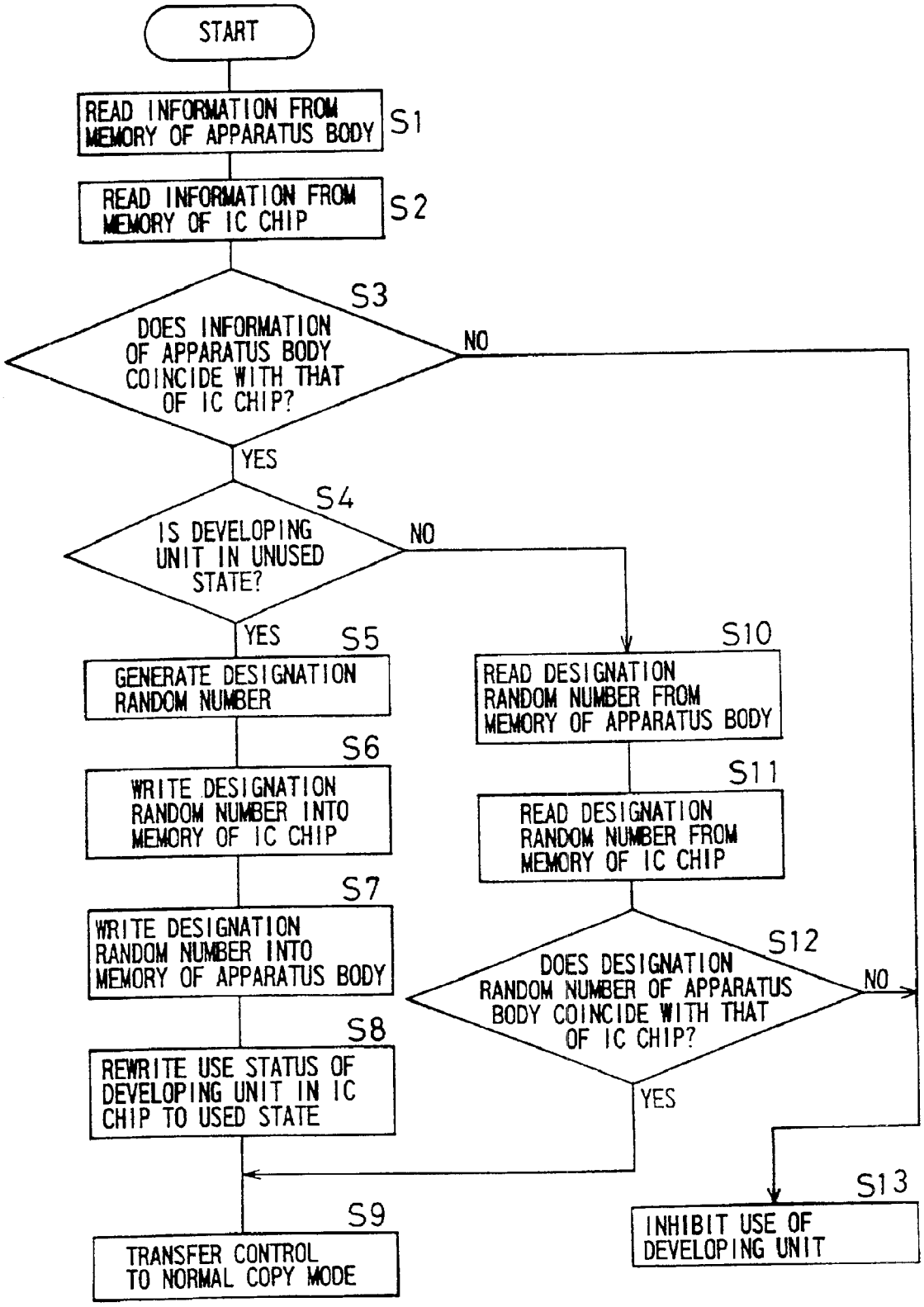
FIG. 4 is a flowchart showing an example of operations of a CPU in the apparatus body.

Next, a part of the above-described operations of the CPU 33 will be described in more detail with reference to the flowchart of FIG. 4.

When the power source of the apparatus body 1 is turned on, the CPU 33 first reads information relating to the image forming apparatus from the memory 34 of the apparatus body 1 (step S1), and reads information relating to an image forming apparatus in which the developing unit can be used, from the memory 30 of the IC chip 31 of the developing unit 16 (step S2). Next, the CPU 33 judges whether information of the apparatus body 1 coincides with that of the IC chip 31 or not (step S3). If the coincidence is attained, the CPU 33 judges from the information stored in the memory 30 of the IC chip 31 whether the developing unit 16 is in an unused state or not (step S4). If the apparatus is in an unused state, the CPU 33 generates a designation random number (step S5). The designation random number is written into the memory 30 of the IC chip 31 (step S6), and also into the memory 34 of the apparatus body 1 (step S7). In the memory 30 of the IC chip 31, the area into which the use status of the developing unit 16 is to be stored is rewritten to a used state (step S8). Then, the control is transferred to the normal copy mode (step S9).

If it is judged in step S4 that the developing unit 16 is not in an unused state, the CPU 33 reads the designation random number stored in the memory 34 of the apparatus body 1 (step S10), and the designation random number stored in the memory 30 of the IC chip 31 (step S11), and compares the numbers with each other (step S12). If the numbers coincide with each other, the control advances to step S9 to be transferred to the normal copy mode. If it is judged in step S12 that the designation random number of the apparatus body 1 does not coincide with that of the IC chip 31, or if it is judged in step S3 that the information of the apparatus body 1 does not coincide with that of the IC chip 31, the CPU 33 inhibits the use of the developing unit 16 (step S13).

The above-described operations are performed each time the power source of the apparatus body 1 is turned on. When the developing unit 16 in an unused state is attached at the first time to the developing unit 16, therefore, the same designation random number is written into the memory 34 of the apparatus body 1 and the memory 30 of the IC chip 31. If information including the designation random number stored in the memory 34 of the apparatus body 1 does not coincide with that stored in the memory 30 of the IC chip 31, thereafter, it is judged that an erroneous developing unit 16 is attached, and the use of the developing unit 16 can be inhibited. Consequently, erroneous insertion of the developing unit 16 can be prevented, and the troubles due to erroneous insertion can be prevented from being caused.

In the image forming apparatus, each time an operation relating to the lifetime of the developer is conducted during a copying process, the CPU 33 executes writing onto the developer lifetime information storage area of the memory 30 of the IC chip 31 of the developing unit 16, and judges whether the lifetime of the developer has expired or not. In the embodiment, the writing onto the lifetime information storage area is conducted each time printing of one sheet is performed.

As shown in FIGS. 5 to 11, for example, the lifetime information storage area in the memory 30 of the IC chip 31 is configured by an m-byte rewritable portion and an n-byte non-rewritable portion.

As shown in FIG. 5, all of the rewritable and non-rewritable portions of the lifetime information storage area are initially cleared to "00". In the following description, it is assumed that numerals in " " indicate a 1-byte BCD (binary coded decimal code). Each time printing of one sheet is performed, "FF" is written sequentially with starting from address 1 of the rewritable portion. FIG. 6 shows a state where printing has been performed on an i number of sheets and "FF" is written into addresses 1 to i of the rewritable portion. When "FF" is written into addresses 1 to m of the rewritable portion and no writable address exists in the rewritable portion as shown in FIG. 7, the whole of the rewritable portion is cleared to "00", and "FF" is written into address 1 of the non-rewritable portion as shown in FIG. 8. Thereafter, the above-described operations are repeated. Namely, repeated are the operations of: writing "FF" sequentially with starting from address 1 of the rewritable portion which has been cleared; and, with the timing when "FF" is written into address m of the rewritable portion and writable address exists in the rewritable portion, clearing the whole of the rewritable portion to "00", and writing "FF" sequentially into the non-rewritable portion. When it is detected that there is no writable area in the non-rewritable portion, it is judged that the lifetime of the developer has expired and replacement timing of the developing unit 16 is detected. An instruction for replacement of the developing unit 16 is given through the display panel of the apparatus body 1 or the like.

FIG. 9 shows a state where, after "FF" is written into addresses 1 to (n−1) of the non-rewritable portion, "FF" is written into address m of the rewritable portion so that no writable address exists in the rewritable portion. For example, the instructions for replacement of the developing unit 16 can be given at a time when, after the state of FIG. 9, the whole of the rewritable portion is cleared to "00" and "FF" is written into address n of the non-rewritable portion as shown in FIG. 10. Alternatively, writing onto the rewritable portion may be continued even after the state of FIG. 10 is attained, and the instructions may be given at a time when "FF" is written into address m of the rewritable portion and no writable address exists in the rewritable portion as shown in FIG. 11.

Depending on the kind of the developer used in the developing unit 16, the lifetime of the developer may expire from the viewpoint of the number of sheets to be printed, although the developer remains in the developing unit 16. Even in such a case, when the above-described process is conducted, printing can be prevented from being performed with exceeding the lifetime of the developer, and the printing quality can be prevented from becoming unstable. The developer lifetime information storage area is disposed in the nonvolatile memory 30 of the IC chip 31. Even when the power source of the apparatus body 1 is turned off, or when the developing unit 16 is detached from the apparatus body 1, therefore, information which has been written into the developer lifetime information storage area before this timing is not vanished. Particularly, information which has been once written into the non-rewritable portion of the developer lifetime information storage area cannot be intentionally rewritten. Therefore, the lifetime of the developer can be correctly detected based on the information written into the developer lifetime information storage area. Before the replacement timing of the developing unit 16 is detected, moreover, the CPU 33 can perform writing operations of a number (m×n) which is equal to a product of the number m of the rewritable portions and the number n of the non-rewritable portions, on the developer lifetime information storage area. As compared with the case where the whole of the developer lifetime information storage area is used as the non-rewritable portions and writing is performed sequentially onto the non-rewritable portions only, therefore, the total capacity of the developer lifetime information storage area which is required for performing the same number of writing operations can be reduced.

Although a copying apparatus has been described in the embodiment above, the invention may be applied to an image forming apparatus other than a copying apparatus, a combined image forming apparatus having plural functions, and the like.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

an apparatus body having an image forming unit;

a developer supply container detachable attached to the image forming unit, for supplying a developer in forming an image;

container side nonvolatile storage means, disposed an the developer supply container, for storing information relating to the developer supply container; and processing means disposed in the apparatus body, having a function of writing predetermined information into the container side nonvolatile storage means.

2. The image forming apparatus of claim 1, further comprising:

body side nonvolatile storage means for storing5 information relating to the developer supply container, wherein the processing means has a function of judging whether the developer supply container is usable or not, based on the information stored in the container side nonvolatile storage means, and the information stored in the body side nonvolatile storage means.

3. The image forming apparatus of claim 1, wherein the container side nonvolatile storage means are provided with a rewritable portion and a non-rewritable portion, the non-rewritable portion is effective to receive writing once and being non-erasable once the writing is performed, and information of higher importance is written into the non-rewritable portion, information of lower importance being written into the rewritable portion.

4. The image forming apparatus of claim 2, wherein the container side nonvolatile storage means are provided with a rewritable portion and a non-rewritable portion, the non-rewritable portion is effective to receive writing once and being non-erasable once the writing is performed, and information of higher importance is written into the non-rewritable portion, information of lower importance being written into the rewritable portion.

5. The image forming apparatus of claim 1, wherein the container side nonvolatile storage means is provided with a developer lifetime information storage area having a predetermined number of non-rewritable portions, the non-rewritable portion is effective to receive writing once and being non-erasable once the writing is performed, in which area information relating to a lifetime of the developer is stored, and the processing means performs writing sequentially onto the non-rewritable portions each time a predetermined operation relating to the lifetime of the developer is performed a predetermined number of times in the image forming unit, and a time when writing onto the non-rewritable portions is disabled is recognized as replacement timing of the developer supply container.

6. The image forming apparatus of claim 2, wherein the container side nonvolatile storage means is provided with a developer lifetime information storage area having a predetermined number of non-rewritable portions, the non-rewritable portion is effective to receive writing once and being non-erasable once the writing is performed, in which area information relating to a lifetime of the developer is stored, and the processing means performs writing sequentially onto the non-rewritable portions each time a predetermined operation relating to the lifetime of the developer is performed a predetermined number of times in the image forming unit, and a time when writing onto the non-rewritable portions is disabled is recognized as replacement timing of the developer supply container.

7. The image forming apparatus of claim 5, wherein the developer lifetime information storage area further has a predetermined number of rewritable portions, and the processing means repeats operations of:

writing sequentially onto the rewritable portions each time a predetermined operation relating to the lifetime of the developer is carried out a predetermined number of times in the image forming unit; and clearing the whole of the rewritable portions each time writing onto a whole of the rewritable portions is ended and writing sequentially onto the non-rewritable portions, the non-rewritable portion is effective to receive writing once and being non-erasable once the writing is performed, and a time when writing onto the non-rewritable portions is disabled is recognized as replacement timing of the developer supply container.

8. The image forming apparatus of claim 6, wherein the developer lifetime information storage area further has a predetermined number of rewritable portions, and the processing means repeats operations of:

writing sequentially onto the rewritable portions each time a predetermined operation relating to the lifetime of the developer is carried out a predetermined number of times in the image forming unit; and clearing the whole of the rewritable portions each time writing onto a whole of the rewritable portions is ended and writing sequentially onto the non-rewritable portions, the non-rewritable portion is effective to receive writing once and being non-erasable once the writing is performed, and a time when writing onto the non-rewritable portions is disabled is recognized as replacement timing of the developer supply container.

9. The image forming apparatus of claim 5, wherein the processing means instructs replacement of the developer supply container at a time when no further portion where writing is enabled exists as a result of writing onto the non-rewritable portions, the non-rewritable portion is effective to receive writing once and being non-erasable once the writing is performed, of the developer lifetime information storage area.

10. The image forming apparatus of claim 6, wherein the processing means instructs replacement of the developer supply container at a time when no further portion where writing is enabled exists as a result of writing onto the non-rewritable portions of the developer lifetime information storage area, the non-rewritable portion is effective to receive writing once and being non-erasable once the writing is performed.

11. The image forming apparatus of claim 7, wherein the processing means instructs replacement of the developer supply container at a time when no further portion where writing is enabled exists as a result of writing onto the non-rewritable portions of the developer lifetime information storage area, the non-rewritable portion is effective to receive writing once and being non-erasable once the writing is performed.

12. The image forming apparatus of claim 8, wherein the processing means instructs replacement of the developer supply container at a time when no further portion where writing is enabled exists as a result of writing onto the non-rewritable portions of the developer lifetime information storage area, the non-rewritable portion is effective to receive writing once and being non-erasable once the writing is performed.

13. The image forming apparatus of claim 5, wherein the processing means instructs replacement of the developer supply container at a time when, after no further portion where writing is enabled exists as a result of carrying out writing onto the non-rewritable portions of the developer lifetime information storage area, requirement for writing into the non-rewritable portions is then produced, the non-rewritable portion is effective to receive writing once and being non-erasable once the writing is performed.

14. The image forming apparatus of claim 6, wherein the processing means instructs replacement of the developer supply container at a time when, after no further portion where writing is enabled exists as a result of carrying out writing onto the non-rewritable portions of the developer lifetime information storage area, requirement for writing into the non-rewritable portions is then produced, the non-rewritable portion is effective to receive writing once and being non-erasable once the writing is performed.

15. The image forming apparatus of claim 7, wherein the processing means instructs replacement of the developer supply container at a time when, after no further portion where writing is enabled exists as a result of carrying out writing onto the non-rewritable portions of the developer lifetime information storage area, requirement for writing into the non-rewritable portions is then produced, the non-rewritable portion is effective to receive writing once and being non-erasable once the writing is performed.

16. The image forming apparatus of claim 8, wherein the processing means instructs replacement of the developer supply container at a time when, after no further portion where writing is enabled exists as a result of carrying out writing onto the non-rewritable portions of the developer lifetime information storage area, requirement for writing into the non-rewritable portions is then produced, the non-rewritable portion is effective to receive writing once and being non-erasable once the writing is performed.

17. An image forming apparatus comprising:

an apparatus body having an image forming unit;

a developer supply container detachable attached to the image forming unit, for supplying a developer in forming an image;

container side nonvolatile storage means operatively connected to the developer supply container, for storing information relating to the developer supply container; and processing means disposed in the apparatus body, having a function of writing predetermined information into the container side nonvolatile storage means.

18. The image forming apparatus of claim 17, wherein the developer supply toner container supplies toner to a developer tank of the image forming unit.

19. The image forming apparatus of claim 1, wherein the container side nonvolatile storage means includes an IC chip.

20. The image forming apparatus of claim 2, wherein the container side nonvolatile storage means includes an IC chip.

21. The image forming apparatus of claim 1, wherein the information is the quantity of toner in the developer.

22. The image forming apparatus of claim 17, wherein the information is the quantity of toner in the developer.

* * * * *